United States Patent [19]

Michlovic

[11] Patent Number: 4,817,351

[45] Date of Patent: Apr. 4, 1989

[54] GLAZING SYSTEM

[75] Inventor: John J. Michlovic, Avon Lake, Ohio

[73] Assignee: The Standard Products Company, Cleveland, Ohio

[21] Appl. No.: 114,693

[22] Filed: Oct. 29, 1987

[51] Int. Cl.[4] ..... E04H 3/00

[52] U.S. Cl. ..... 52/235; 52/398; 52/400; 52/403

[58] Field of Search ..... 52/397, 398, 400, 403, 52/235, 393, 204, 213, 207, 770, 776, 775

[56] References Cited

U.S. PATENT DOCUMENTS

| | | | |
|---|---|---|---|
| Re. 30,432 | 11/1980 | Stoakes . | |
| 3,182,766 | 5/1965 | Ferrell . | |
| 3,316,681 | 5/1967 | Eber . | |
| 3,336,707 | 8/1967 | Horgan, Jr. . | |
| 3,435,579 | 4/1969 | Horgan, Jr. . | |
| 3,846,951 | 11/1974 | Paull . | |
| 3,866,374 | 2/1975 | Dallen | 52/400 |
| 3,867,799 | 2/1975 | Pryor et al. . | |
| 3,932,974 | 1/1976 | Wright . | |
| 3,968,608 | 7/1976 | Swango . | |
| 3,974,613 | 8/1976 | Criswell . | |
| 4,001,994 | 1/1977 | Williams et al. . | |
| 4,121,396 | 10/1978 | Oogami et al. . | |
| 4,418,506 | 12/1983 | Weber et al. | 52/400 X |

*Primary Examiner*—David A. Scherbel
*Assistant Examiner*—Creighton Smith
*Attorney, Agent, or Firm*—Harness, Dickey & Pierce

[57] ABSTRACT

A glazing system enabling the utilization of two chemically incompatible sealing materials in the same glazing system is disclosed. The glazing system includes a frame member secured to a building to support the glazing structure. Generally the frame member defines a ribbon window opening in the building. A pair of resilient polymeric gasket strips are coupled with the frame member and positioned such that they are parallel with one another and at a desired distance apart. A channel for receiving glass is formed in each of the gaskets. The channels oppose one another to receive the horizontal edges of the glass. A plurality of mullions are positioned substantially perpendicular to the gaskets and are coupled with the frame member in the ribbon window opening. A plurality of glass lites are positioned in the glass channels and nest on the mullions. A member may project from each mullion and is sandwiched between adjacent glass lites to form a gap between adjacent glass lites. A plurality of separating members are positioned in the channels adjacent the projecting members such that the separation members are positioned opposing one another in the gasket opposing glass channels between the adjacent glass lites. The separation members extend a desired distance from the gaskets. A plurality of liquid sealant beads are positioned in the gaps and abut the separation members such that the sealant beads are prohibited from contact with the gasket strips.

7 Claims, 4 Drawing Sheets

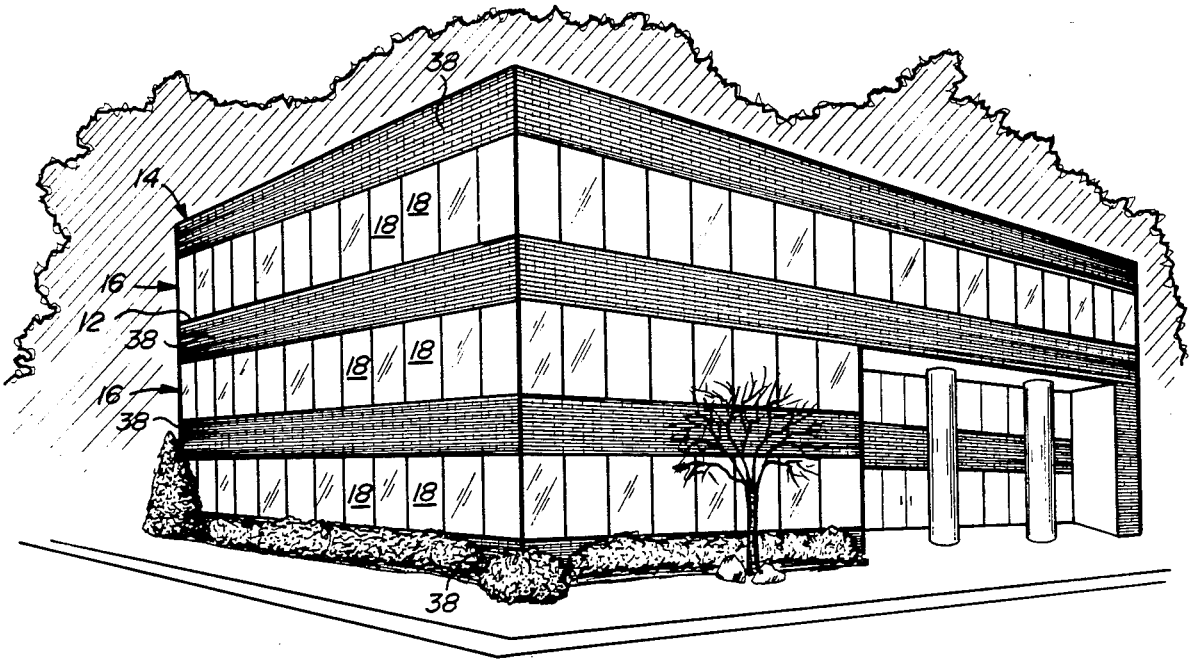
FIG. 1
FIG. 2
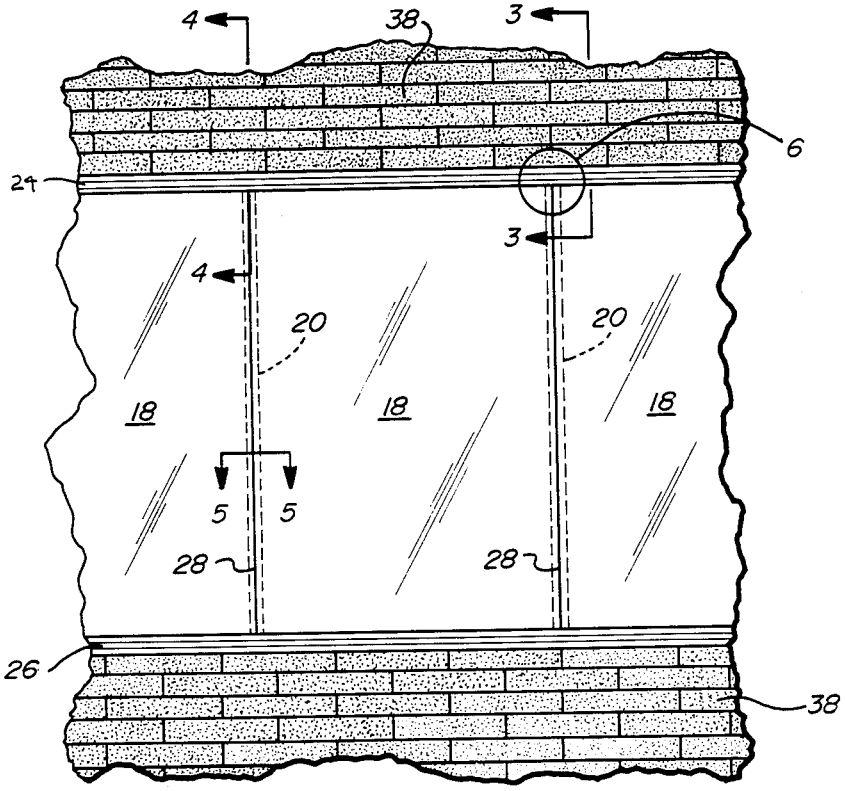

GLAZING SYSTEM

The present invention relates to glazing systems. More particularly, the present invention relates to building ribbon or window wall glazing systems which enable chemically incompatible gaskets and sealants to be utilized together to mount glass or panels.

Structural glazing is a rapidly-growing technique for installing glass, utilizing the unique properties of sealants to transfer structural loads from the glass to the perimeter framing. Also, structural glazing provides a desired flush appearance on the exterior facade of the building which is aesthetically appealing.

"Two-sided" structural glazing describes a system whereby the glass panels are captured on two sides by a positive clamping mechanism, such as overlapping metal, and the remaining two edges are sealed with silicone caulking.

Generally in "two-sided" structural glazing, sealing of the vertical edges of the glass is accomplished with a field sealant, such as uncured liquid silicone, and sealing of the horizontal edges of the glass is accomplished with an aluminum framing structure. The aluminum framing also includes accessories such as gaskets, spacers, and setting blocks. It is imperative that all the glazing components work in concert with each other and that the components are compatible with one another. Neoprene gaskets and silicone sealants are chemically incompatible; therefore, their use together may result in staining and/or a loss of the adhesion of the glass to metal or glass to glass by the sealants.

Types of glazing systems are illustrated in the following patents. U.S. Pat. Nos. Re. 30,432; 3,336,707; 3,435,579; 3,846,951; 3,316,681; 3,932,974; 3,974,613; 4,121,396; 3,968,608; 4,001,994; 3,182,766 and 3,867,799 illustrate different types of glazing systems. However, these types of systems have several disadvantages. While some of the systems illustrate the use of gaskets they do not combine the gaskets with liquid sealants. Also the systems are very complicated and complex in assembly.

There is a need in the field for a simple glazing system which enables resilient gaskets manufactured from neoprene rubber to be combined with chemically incompatible liquid sealants, such as uncured silicone, without staining or reducing the adhesion of the glass to glass or glass to the metallic framing components. The resulting glazing system, as described forthwith, will provide thermal, acoustical, and maintenance advantages over those known in the art.

Accordingly, since neoprene rubber and silicone sealants possess desired characteristics for use as a system, there is a need in the art to overcome the chemical incompatibility. The present invention provides a glazing system which enables the glazer to utilize neoprene gaskets and uncured silicone sealants on the same window installation.

In accordance with the invention, a framing support structure is generally secured to the structure of a building. Preferably, the frame structure defines a ribbon or continuous horizontal opening in a building; that is a row of windows horizontally about the perimeter of a building having building materials such as steel panels, concrete panels or the like positioned above and below the row of windows. A pair of resilient gasket strips are attached to the framing and are positioned parallel to one another with the glass receiving channels opposing one another and at a desired distance apart. A plurality of mullions are positioned perpendicular to the gaskets and attached to the support members in the ribbon openings a desired distance from one another. A plurality of glass lites are positioned in the gasket channels and nest against the mullions. A member projects from the mullions and is sandwiched between adjacent sheets of glass to form a gap between the glass lites. These members are discontinuous at the gasket strips. A plurality of silicone compatible separating members are positioned in the gasket channels above and below the mullion projecting members. The separating members project a desired distance from the gaskets towards the ends of the projecting members. A plurality of sealant beads are positioned in the gaps between adjacent glass lites abutting the separation members such that the sealant beads do not contact the gasket strips.

From the subsequent description and the appended claims taken in conjunction with the accompanying drawings, additional objects and advantages of the present invention will become apparent to one skilled in the art.

BRIEF DESCRIPTION OF THE DRAWINGS

FIG. 1 is a perspective view of a building including the glazing system of the present invention;

FIG. 2 is a partial front elevation view of a glazing system in accordance with the present invention;

DETAILED DESCRIPTION OF THE PREFERRED EMBODIMENT

Figure 3:
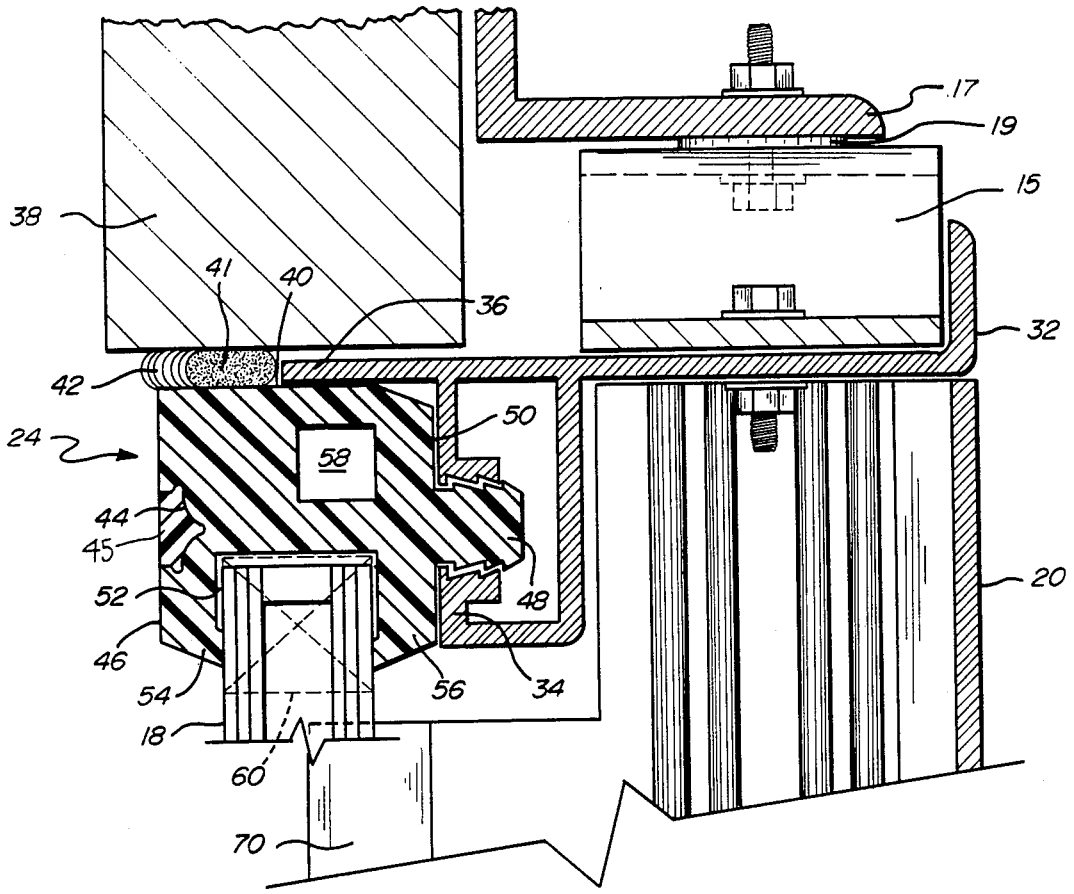
FIG. 3 is a cross section view of FIG. 2 along line 3—3 thereof.

Turning to the figures, a glazing system is illustrated and designated with the reference numeral 10. Glazing system 10 is illustrated in a ribbon opening 12 on a building 14. The ribbon opening 12 is horizontally continuous about the perimeter of the building establishing a ribbon window wall 16 formed with glass panels 18.

Turning to FIG. 2 a partial section of the glazing system 10 is shown. A glass panel 18 is illustrated positioned between a pair of vertical mullions 20 and a pair of horizontal gasket strips 24, at the window "head", and 26, at the "sill". Also, sealant beads 28 seal and adhere the vertical edges of the glass panel 18 with the mullions 20 and adjacent glass panels.

Moving to FIG. 3, a support frame 32 is illustrated secured to the building by a Z-clamp 15 and support 17. Shims **19*a* provide adjustment capability at both the head and sill. Support frame 32 includes a member 34 to secure the gasket strips 24 and 26 to the support frame 32 by insertion of gasket spline 48. An extending flange 36 projects beyond the gasket securement portion 34 to provide load support for the glass at the sill condition and to provide a stop for the backer rod 41. The flange 36 also defines the outline of the window ribbon wall 16 in the building 14. A sealant bead 42 is positioned between the first surface 40 of the gasket and the building section 38 to seal the gap between building section 38 and gasket strips 24 and 26**.

The gasket strips 24 and 26 are substantially identical and the below description will apply to both gasket strips 24 and 26. The gaskets 24 and 26 have an overall rectangular shape with a locking strip cavity 44 on a second surface 46 and a anchoring spline 48 on a third surface 50, which is substantially parallel with the second surface 46. Also, a locking strip 45 is inserted into the locking strip cavity 44 to horizontally retain the glass panel in the gasket strips 24 and 26. A glass receiving channel 52 is formed between two wings 54 and 56 on the gaskets 24 and 26. Also, a bore 58 is longitudinally continuous through the gasket to provide the gasket with an absorbing means to enable movement or the like of the glass panels 18 due to movement from insertion, vibration or the like movement. This void 58 also reduces the required amount of neoprene in the gasket strips.

Figure 4:
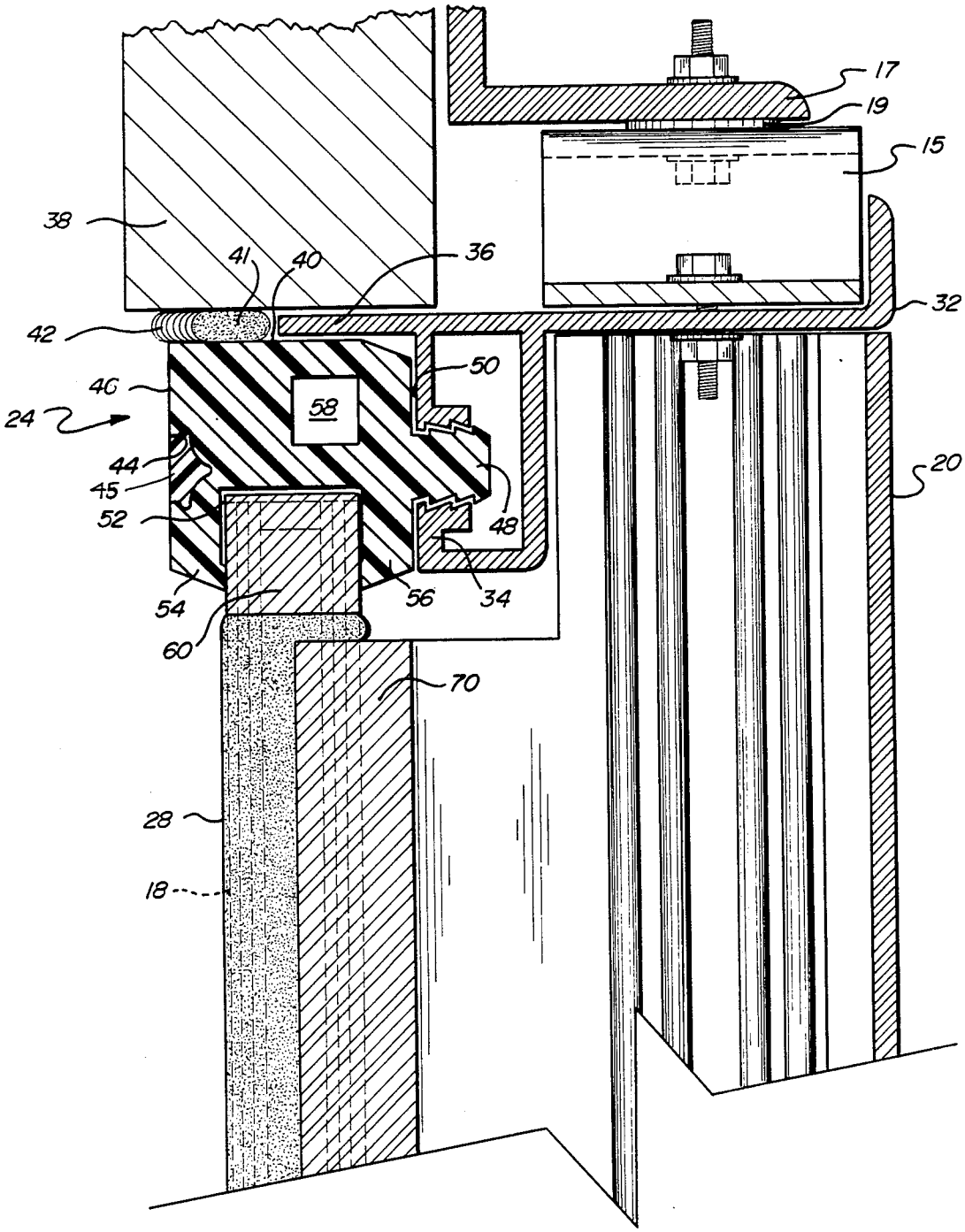
FIG. 4 is a cross section view of FIG. 2 along line 4—4 thereof.
Figure 6:
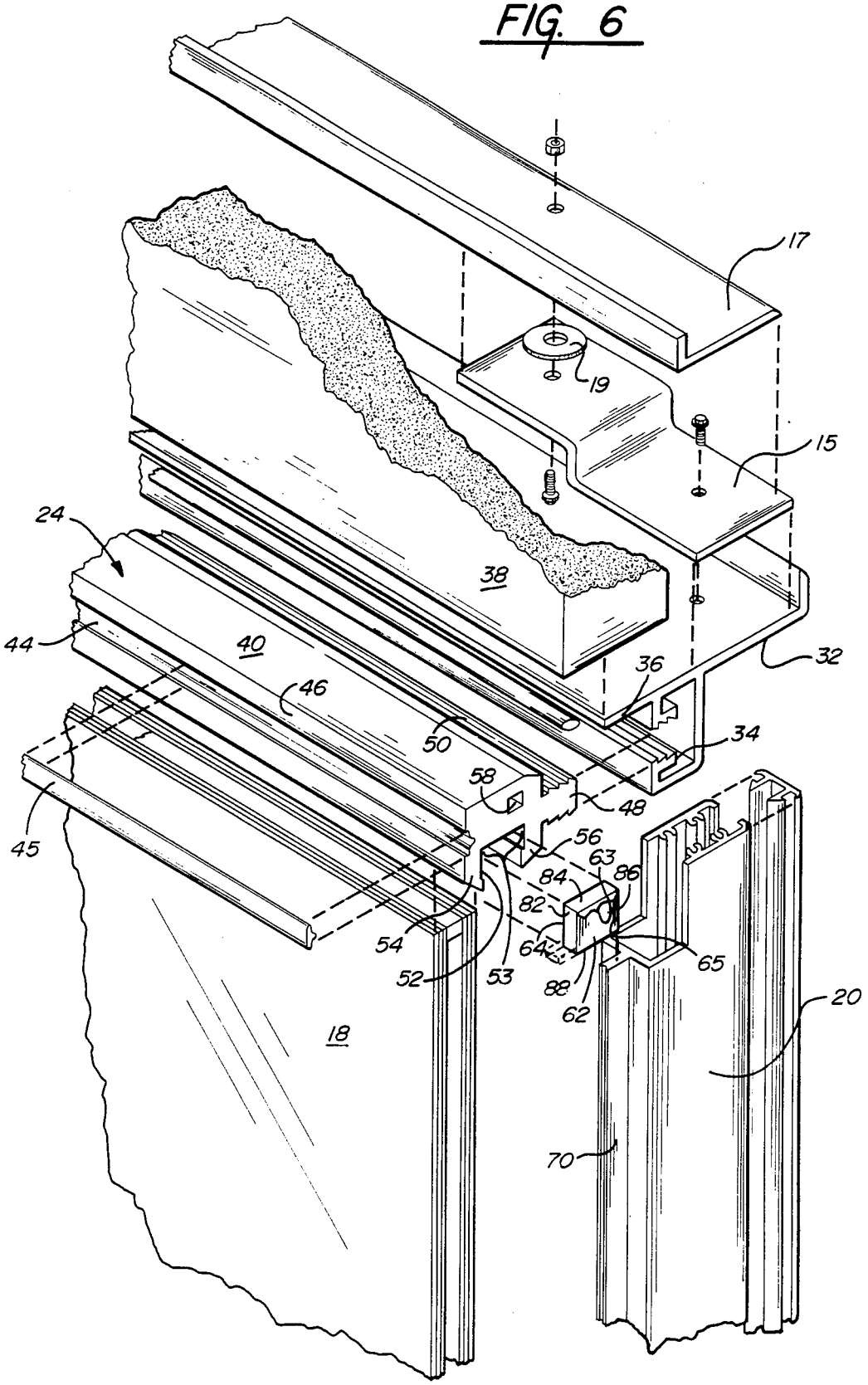
FIG. 6 is a partial exploded view of the portion of FIG. 2 within circle 6.

Turning to FIG. 4, a gasket is illustrated with a separation member 60 positioned within the channel 52. The separation member 60 is cube shaped and has two major faces 62 and 64 and four minor faces 82, 84, 86 and 88 as seen in FIG. 6. The major faces 62 and 64 have a rectangular shape with a width dimension 63 substantially equal to the channel width 53 and a length dimension 65 such that the separation ember 60 extends out of the channel 52 a desired distance beyond the gasket wings 54 and 56 The separation member 60 is generally formed from a flexible material and is chemically compatible with the neoprene rubber of the gasket strips 24 and 26 and with uncured silicone sealant. The separation member 60 also acts as a spacer between adjacent lites of glass.

The beads 28 are preferably a liquid sealant of an uncured silicone rubber material which is applied in the field once the glass panels 18 have been inserted into position on the gasket strips 24 and 26 and mullions 20. The beads 28 abut the separation members 60 and are stopped from contacting the neoprene gasket strips 24 and 26 by the portion of the separation members 60 extending beyond the gasket wings 54 and 56.

Figure 5:
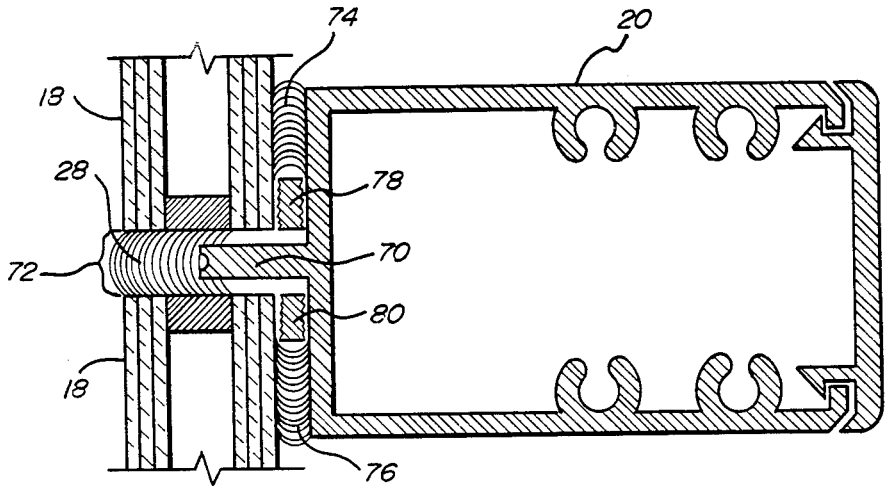
FIG. 5 is a cross section view of FIG. 2 along line 5—5 thereof

As can be seen in FIGS. 4 and 5, the mullion 20 may have a projecting flange 70 which separates adjacent glass panels 18. The flange 70 also forms a gap 72 between adjacent glass panels 18 to enable the sealant beads 28 to be positioned therein. The sealant beads 28 are effective in transferring loads from the glass panels to the perimeter mullion members 20.

FIG. 5 illustrates a pair of sealant beads 74 and 76 positioned between the mullion 20 and glass panels 18 on each side of the flange 70. Also strips of double-sided glazing tape 78 and 80 are positioned on both sides of the flange 70. Both the sealant beads 74 and 76 and glazing tape 78 and 80 enhance the adhesion of the glass panels 18 to the mullion 20. Glazing tape 78 and 80 are principally used to provide temporary positioning and adhesion of the glass panels 18 till sealant beads 28, 74 and 76 are installed.

FIG. 6 illustrates an exploded view of the separation member 60 outside of the channel 52. The separation member 60 may include an arm (shown in phantom) projecting from one of its minor faces which further enhance separation of the sealant beads 28 from the neoprene gaskets 24 and 26.

Generally the contacting of a neoprene gasket with liquid silicone beads will stain and also reduce the adhesion strength of the silicon. The present invention prevents the sealant uncured silicone beads from contacting the neoprene gaskets and enable glazers to utilize the two desirable chemically incompatible materials in the same glazing system.

While the above discloses the preferred embodiment of the present invention, it will be understood that modifications, variations, and alterations may be made to the present invention without varying from the scope and fair meaning of the subjoined claims.

What is claimed is:

1. A glazing system comprising:

means for supporting glazing components secured to structure of a building, said supporting means defining a ribbon window opening in the building, a pair of resilient polymeric gasket strips coupled with said support means and positioned parallel to one another a desired distance apart, a channel in each of said gaskets for receiving glass lites or panels, said channels opposing one another, a plurality of mullions positioned substantially perpendicular to said gaskets and coupled with said support means in said ribbon window opening, a plurality of glass panels positioned in said gasket channels and nesting on said mullions, a member projecting from each said mullion and sandwiched between adjacent glass panels forming a gap between adjacent glass panels, a plurality of separating members positioned in said channels adjacent said projecting members such that said separation members are positioned opposing one another in said opposing channels between adjacent glass panels, said separating members extending a desired distance beyond said gaskets out of said channels, and a plurality of liquid sealant beads positioned in said gaps and abutting said separation members such that said liquid sealant beads are prohibited from contact with said gasket strips.

2. The glazing system according to claim 1 wherein said gaskets are extruded from neoprene rubber.

3. The glazing system according to claim 2 wherein said liquid sealant beads are field applied uncured silicone beads.

4. The glazing system according to claim 3 wherein said separation members are formed from silicone compatible flexible material.

5. The glazing system according to claim 1 wherein said gasket strips and sealant beads are two different polymeric materials that are chemically incompatible.

6. The glazing system according to claim 1 wherein said separating members have a pair of surfaces being substantially parallel to one another, said surfaces aligned in said channel transverse to the axis of said channel and said faces abutting adjacent lites of glass.

7. The glazing system according to claim 1 wherein said separating members are cubes with two major and four minor faces, said two major faces are rectangular having a width substantially equal to the width of said channels and a length such that a portion of the cube projects a desired distance out of the gasket channels, the width of the minor faces are such that a desired bead width is formed in said gaps between said adjacent glass panels for sealing and securing said glass panels to said mullions.

* * * * *